US006726185B1

(12) United States Patent
Del Sole

(10) Patent No.: US 6,726,185 B1
(45) Date of Patent: Apr. 27, 2004

(54) ROLLOVER VALVE FOR CARBURETOR FLOAT BOWLS

(75) Inventor: Robert Joseph Del Sole, Larchmont, NY (US)

(73) Assignee: Robert J. Del Sole, Larchmont, NY (US)

( * ) Notice: Subject to any disclaimer, the term of this patent is extended or adjusted under 35 U.S.C. 154(b) by 0 days.

(21) Appl. No.: 10/202,300

(22) Filed: Jul. 24, 2002

Related U.S. Application Data

(60) Provisional application No. 60/314,549, filed on Aug. 24, 2001.

(51) Int. Cl.[7] ..... F02M 5/12
(52) U.S. Cl. ..... 261/70; 261/DIG. 67
(58) Field of Search ..... 261/70, DIG. 67

(56) References Cited

U.S. PATENT DOCUMENTS

| | | | | | |
|---|---|---|---|---|---|
| 1,814,118 | A | * | 7/1931 | Bracke | 261/72.1 |
| 2,920,877 | A | * | 1/1960 | Spragle | 261/42 |
| 3,020,030 | A | * | 2/1962 | Capehart | 261/36.2 |
| 3,752,135 | A | * | 8/1973 | Peterson et al. | 123/519 |
| 3,778,024 | A | * | 12/1973 | Rogerson | 251/63 |
| 4,250,856 | A | * | 2/1981 | Abbey | 123/439 |
| 5,133,905 | A | * | 7/1992 | Woody et al. | 261/35 |

FOREIGN PATENT DOCUMENTS

| | | | | |
|---|---|---|---|---|
| JP | 53-74632 | * | 7/1978 | 261/DIG. 67 |

* cited by examiner

*Primary Examiner*—Richard L. Chiesa

(57) ABSTRACT

A carburetor structure in which gasoline cannot leak out of a carburetor vent tube when oriented at an angle larger than ninety degrees with respect to the vertical.

1 Claim, 4 Drawing Sheets

PRIOR ART

PRIOR ART

ROLLOVER VALVE FOR CARBURETOR FLOAT BOWLS

CROSS REFERENCE TO CO-PENDING APPLICATION

The present application is a continuation-in-part to application entitled ROLLOVER VALVE FOR CARBURETOR FLOAT BOWLS, Ser. No. 60/314,549, filed Aug. 24, 2001.

BACKGROUND OF THE INVENTION

While many types of vehicles utilizing internal combustion engines powered by gasoline utilize fuel injection systems to deliver and meter the necessary air-fuel mixtures, other types of vehicles as for example, vehicles used in auto racing use carburetors for delivering and metering the necessary air-fuel mixtures.

These carburetors contain therein one or more float bowls that acts as a reservoir for the fuel, typically gasoline. Each bowl requires some type of air venting mechanism in order for the carburetor to draw fuel from the reservoir. If the bowl is not vented to the outside atmosphere, a vacuum will be created that will prevent the carburetor from properly drawing fuel. One method for venting is to install one or more vent tubes into the top of the bowl that normally extend vertically upward. Each tube is open at its upper end.

During normal vehicular operation, this carburetor arrangement functions properly. However, under extreme conditions such as auto racing, vehicles can become unstable and turn partially or completely over. Under these conditions, the tube can be rotated to an angle in excess of ninety degrees. The gasoline in the bowls then leaks out of the tubes. A vehicle so rendered unstable during a race has an extremely hot exhaust system. The leaking gas can engage the exhaust system and create dangerous fires.

SUMMARY OF THE INVENTION

It is an object of the present invention to provide a new and improved carburetor structure in which gasoline cannot leak out of carburetor vent tubes when disposed horizontally or vertically whereby the danger of leaking gas is eliminated.

Another object is provide in each fuel bowl a check valve mechanism connected to the vent tube which allows normal carburetor operation when the tube is disposed vertically but prevents fuel leakage out of the tube when the tube is disposed at an angle greater than ninety degrees from the vertical.

Yet another object is to provide a new and improved carburetor structure of the character indicated that can be manufactured easily and inexpensively.

These and other objects and advantages of the invention will either be explained or will become apparent hereinafter.

In accordance with the principles of this invention, a normally vertical vent tube open at its upper end is connected at its open lower end by a horizontal air conduit to the top of a fuel bowl. The lower end has a recess in which is mounted a check valve mechanism. When the tube is in its normally vertical position, the mechanism permits the air venting function of the tube to operate in the normal manner. However, when the tube is oriented at an angle greater than ninety degrees from the vertical, then mechanism seals off and blocks the air venting mechanism, thus preventing the fuel leakage and eliminating danger of fire.

The mechanism can be a sphere having a diameter somewhat larger than that of the inner diameter of the tube.

During normal operation, the sphere rests in the recess and is spaced from the lower end of the tube. When the tube is tilted to an angle greater than ninety degrees from the vertical, the sphere engages the lower end of the tube, blocking air flow therethrough and preventing gasoline leakage discharge.

DETAILED DESCRIPTION OF PREFERRED EMBODIMENT

Figure 1:
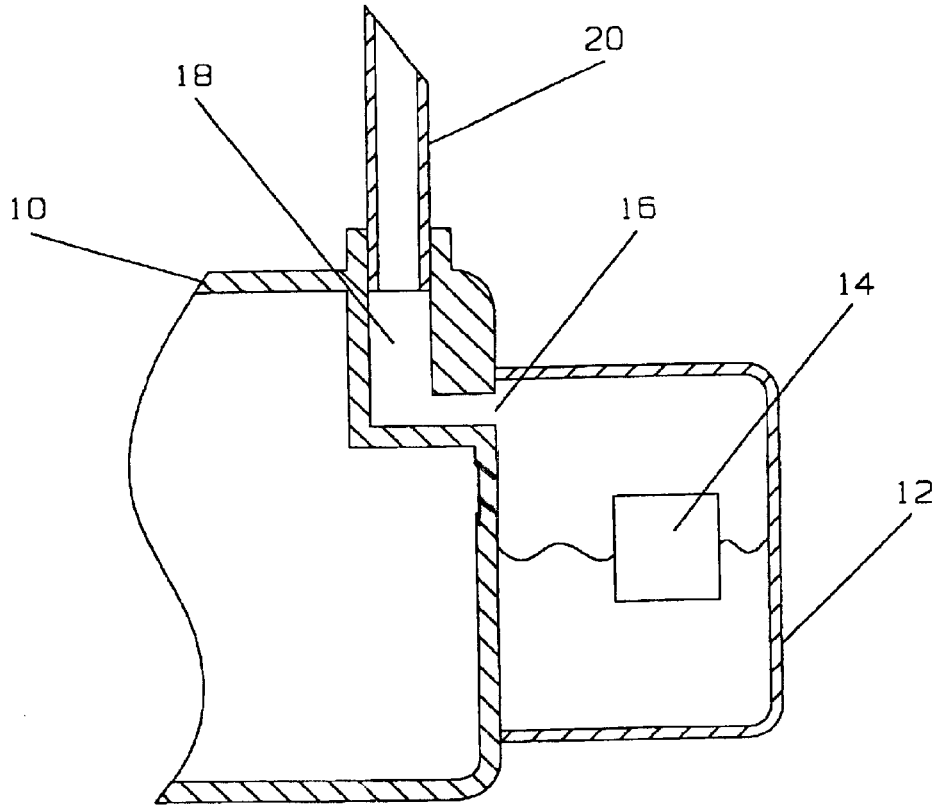
FIG. 1 is a cut away side view of a conventional carburetor shown in normal operating position with the vent tube positioned vertically upward.

Referring now to the Figures, a carburetor body 10 contains a float bowl 12 with a float 14. The top of the bowl is connected by a horizontal vent tube passage 16 to a vertical passage 18 that contains an elongated vent tube 20 open at both ends.

Figure 2:
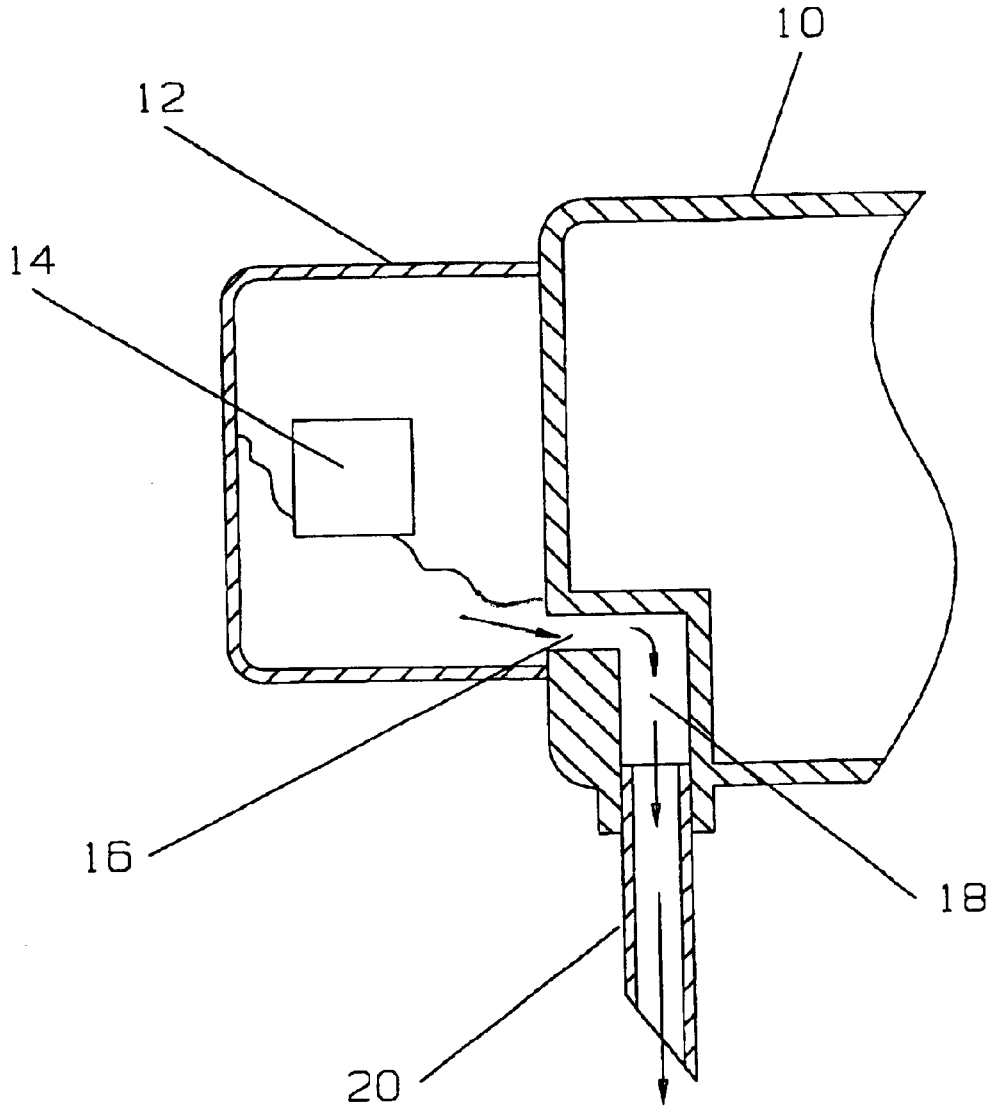
FIG. 2 is a view of the carburetor of FIG. I shown in inverted position with the vent tube positioned vertically downward with gasoline leaking out of the vent tube.

As shown in FIGS. 1 and 2, the vent tube is always vented to the outside atmosphere. When the tube is in normal vertical position, the carburetor functions properly. However, when the carburetor is tilted or invented so that the tube is disposed more than ninety degrees from the vertical, the gasoline leaks out of the float bowl with the resultant adverse results.

Figure 3:
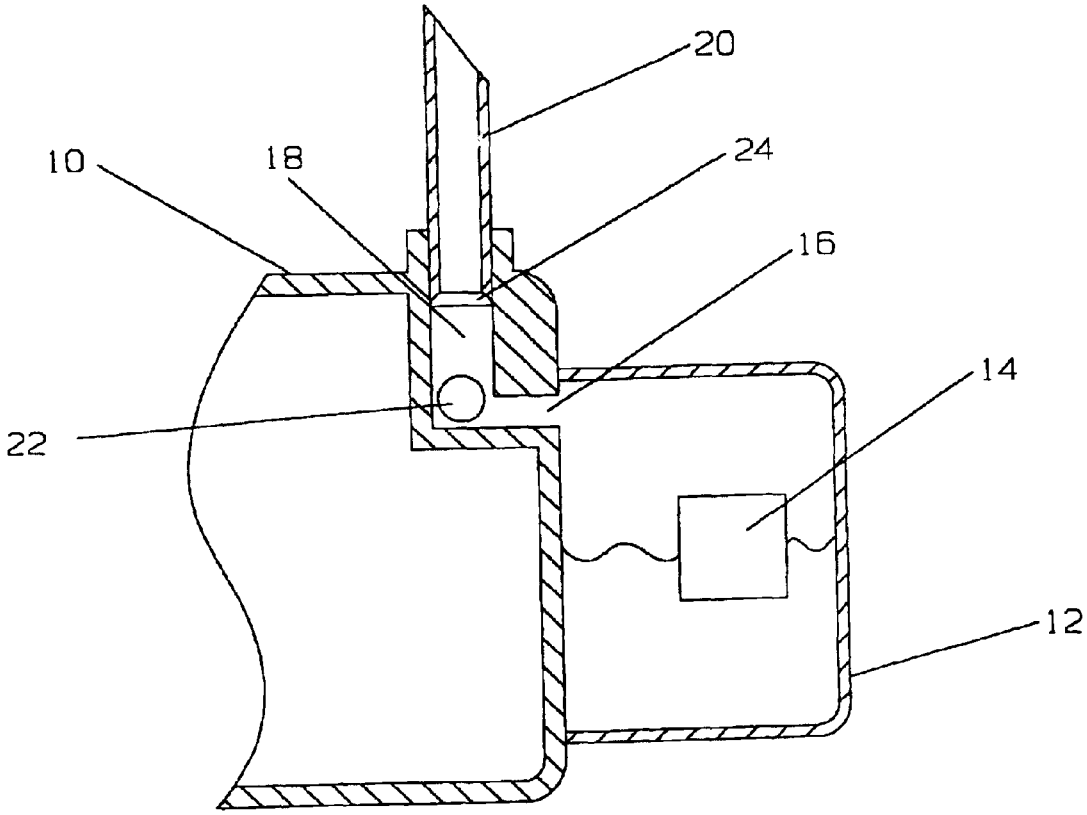
FIG. 3 is a cut away side view of preferred embodiment of the invention shown in normal operating position with the vent tube positioned vertically upward.
Figure 4:
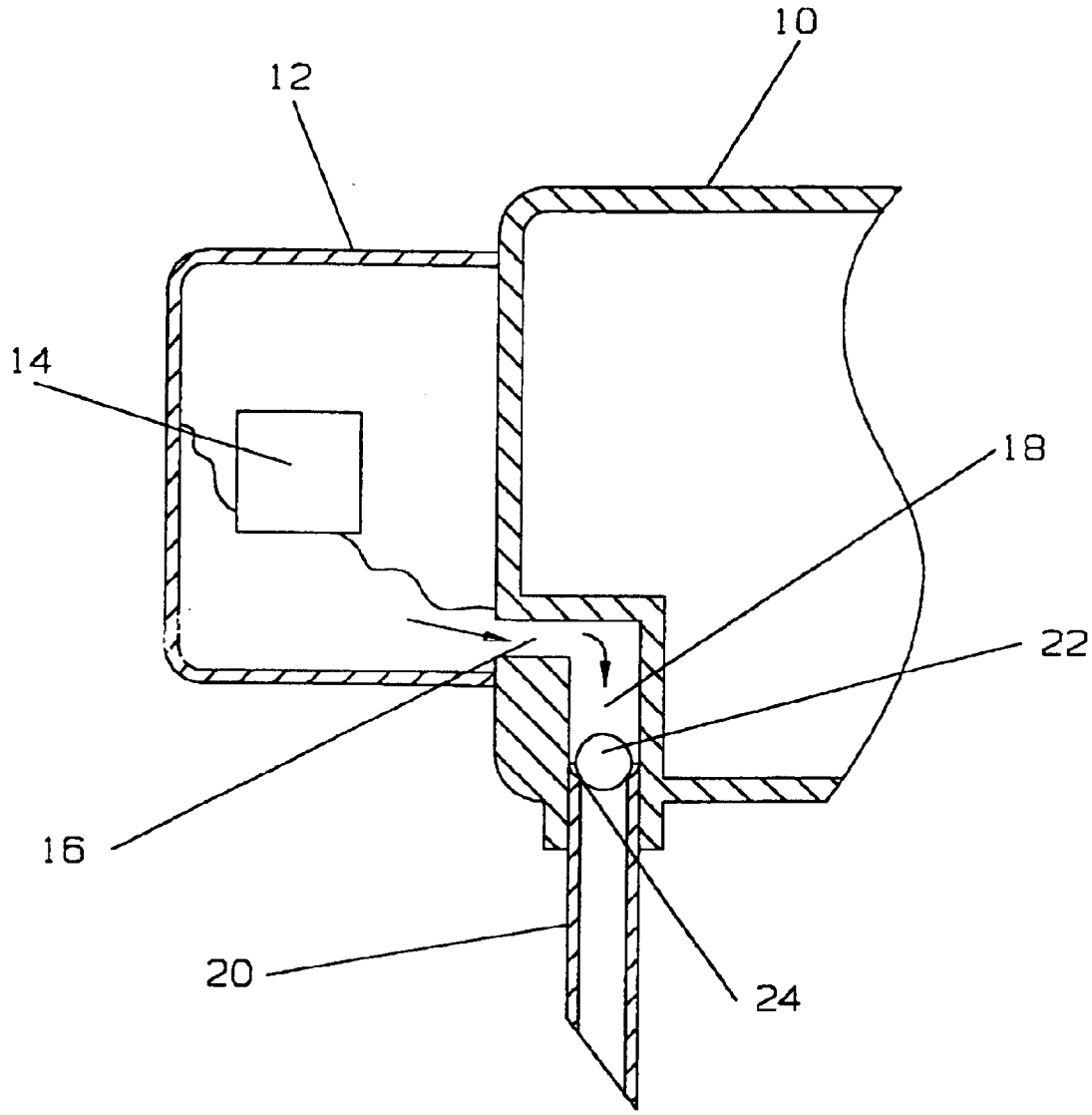
FIG. 4 is a view of the carburetor of FIG. 3 shown in inverted position with the vent tube positioned vertically downward and sealed in accordance with the invention to prevent gasoline leakage.

As shown in FIGS. 3 and 4, however, a check ball 22 is disposed in passage 18, The carburetor functions properly with the vent tube pointing vertically upward and the ball is disposed below the lower opening in the tube. The lower end of the tube is machined to provide a seat 24. When the carburetor is tilted and the tube is disposed at more than ninety degrees from the vertical and in this example is inverted, the ball is contoured to fit into sealing engagement with the seat and seal off the tube so that the gasoline in the float bowl cannot flow out of the tube and is contained in the bowl, thus preventing gasoline leakage.

Once the carburetor is returned to normal position, the ball rolls away from the tube and enables normal carburetor operation.

While the invention has been described with particular reference to the drawings and the preferred embodiment, the protection solicited is to be limited only by the terms of the claims that follow.

What is claimed is:

1. In a carburetor having a body, a float bowl connected to said body, a float in said body, a horizontal vent tube passage extending out of the top of the float bowl and connected to a vertical passage, the improvement comprising:

a vertical vent tube open at both ends including a valve seat in the lower end of the tube and disposed in said vertical passage to vent said bowl to the outside atmosphere when the tube extends vertically upward; and a check valve mechanism comprising a ball disposed in the vertical passage, said mechanism being inoperative when the tube extends vertically upward, but being rendered active when the tube is tilted at an angle larger than ninety degrees with respect to the vertical allowing the ball to engage the valve seat in the lower end of the tube and seal off the tube to prevent leakage of fuel therethrough.

* * * * *